US006425784B1

(12) United States Patent
Touboul

(10) Patent No.: US 6,425,784 B1
(45) Date of Patent: Jul. 30, 2002

(54) CONNECTION PLUG FOR STEREOPHONIC HEADPHONES

(76) Inventor: Armand D. Touboul, Boulevard de la Forêt 32, Pully (CH), 1009

( * ) Notice: Subject to any disclaimer, the term of this patent is extended or adjusted under 35 U.S.C. 154(b) by 0 days.

(21) Appl. No.: 09/946,003

(22) Filed: Sep. 4, 2001

Related U.S. Application Data

(63) Continuation-in-part of application No. 09/555,812, filed on Jun. 5, 2000.

(30) Foreign Application Priority Data

Jun. 28, 1999 (CH) ..... 119599

(51) Int. Cl.[7] ..... H01R 25/00
(52) U.S. Cl. ..... 439/638; 439/669
(58) Field of Search ..... 439/218, 217, 439/623, 640, 937, 638, 668, 669, 675

(56) References Cited

U.S. PATENT DOCUMENTS 3,902,120 A * 8/1975 Dascal et al. ..... 200/51.09
4,324,951 A * 4/1982 Brown ..... 381/77
4,803,728 A * 2/1989 Lueken ..... 381/309
4,855,844 A * 8/1989 Snodgrass ..... 360/22

* cited by examiner

*Primary Examiner*—Gary P. Paumen
*Assistant Examiner*—James R. Harvey
(74) *Attorney, Agent, or Firm*—Clifford W. Browning; Woodard, Emhardt, Naughton Moriarty & McNett

(57) ABSTRACT

The connection plug (1) has two pins (4, 5) of the jack type, one of the pins having two coaxial conductors (42, 44) and the second having three coaxial conductors (52, 55, 57), said connecting plug comprising two distinct parts (2, 3), each of said parts supporting one of said pins, said distinct parts having members intended for their connection/disconnection and means for their electrical connection, whereby said connection plug can be converted into a connection plug for stereophonic headphones with a single pin.

8 Claims, 3 Drawing Sheets

Figure 1:
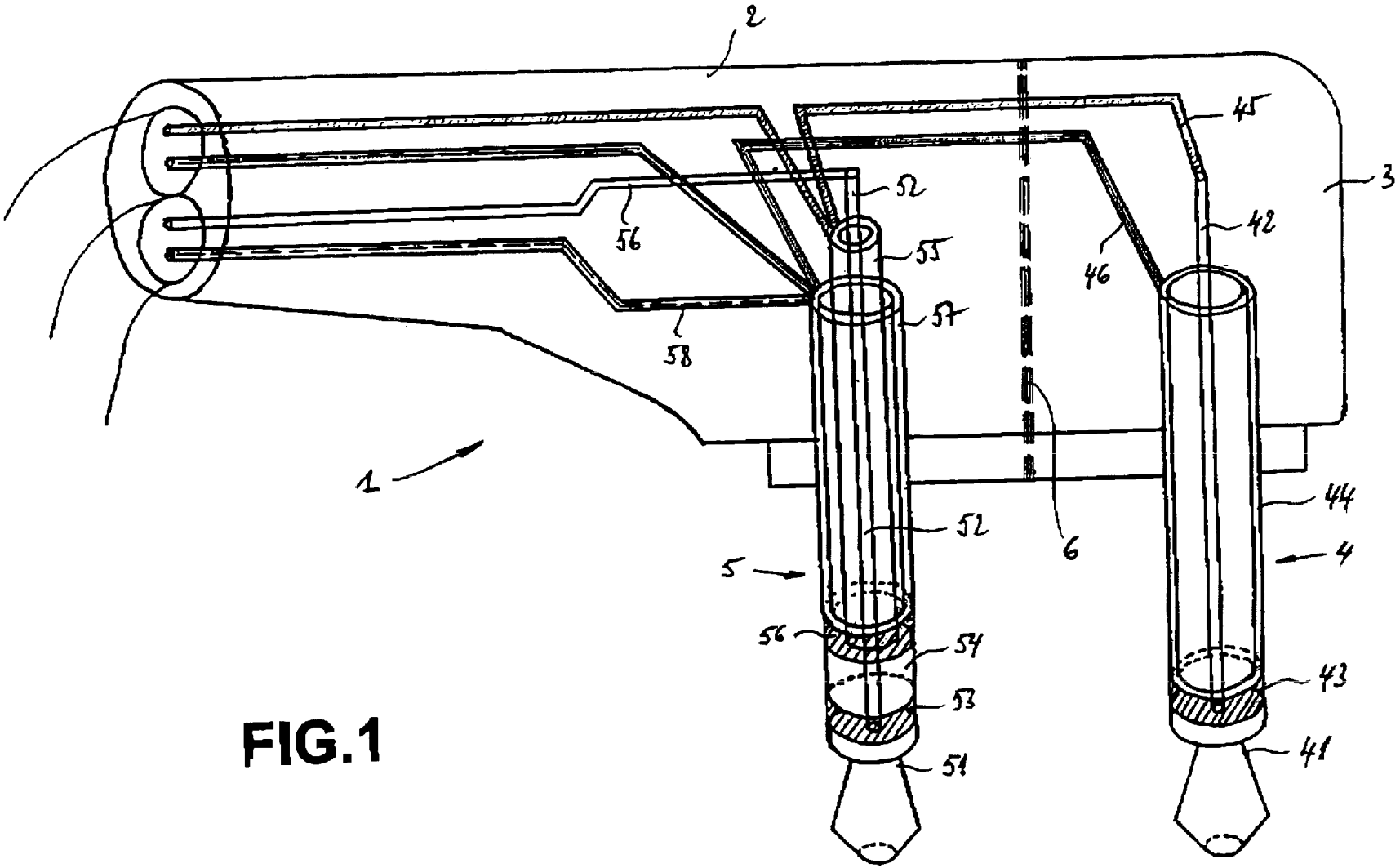

FIG.2
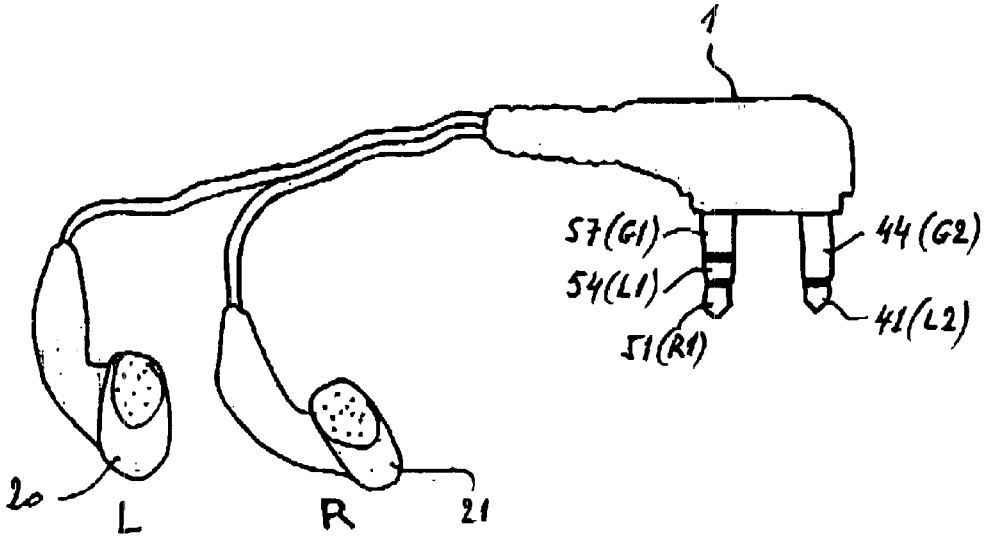
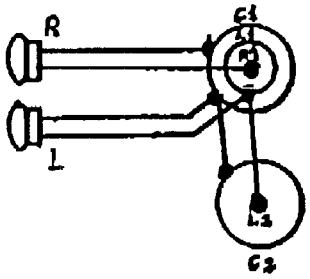
FIG.3

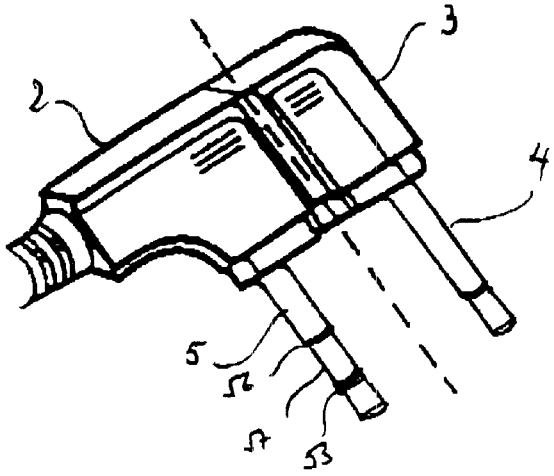
FIG.4
FIG.5
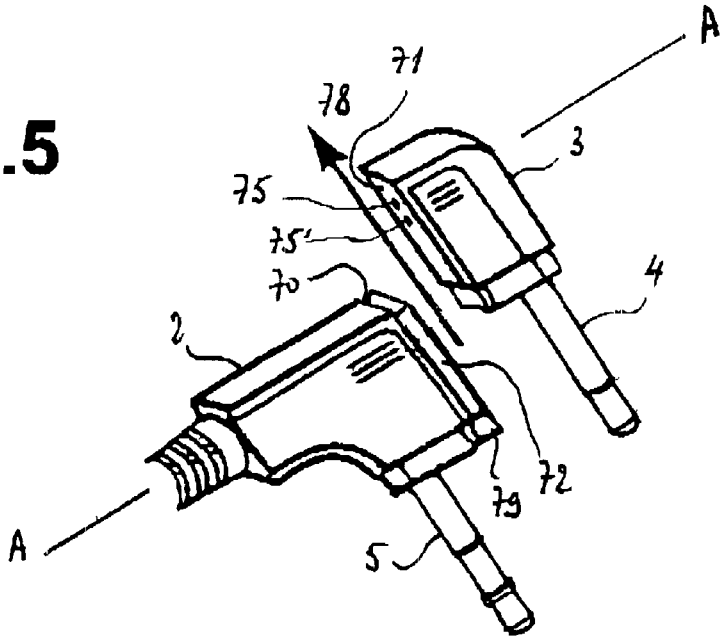
FIG.6
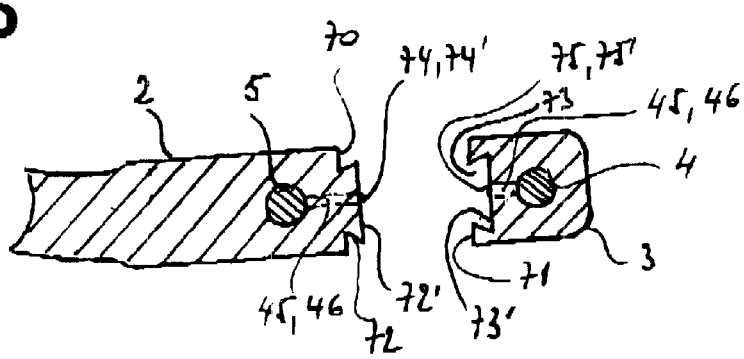

CONNECTION PLUG FOR STEREOPHONIC HEADPHONES

This application is a continuation-in-part of prior U.S. patent application Ser. No. 09/555,812, filed Jun. 5, 2000.

The present invention concerns a connection plug for stereophonic headphones having two connection pins.

The stereophonic headphones distributed to aircraft passengers have a connection plug with two pins, each of the pins being intended for the transmission of the signals on one of the stereo channels. At the end of the flight, these headphones are generally recovered by the crew, after which they are cleaned and disinfected with a view to future use by other passengers during another flight.

However, such devices are by nature fairly fragile and usually become unusable after a few uses.

Moreover, because they have two connection pins, it cannot be envisaged offering them to the passengers, whether free or for a charge, since the majority of normal items of audio-visual equipment such as Walkmans, Discmans, televisions, etc. are arranged for the connection of stereophonic headphones with a single pin.

The aim of the present invention is to propose a connection plug for stereophonic headphones which can be used both in aircraft and with the most diverse stereophonic audio-visual equipment.

To this end, the invention concerns a connection plug for stereophonic headphones, having two connection pins, arranged so as to permit either the transmission of a first one of the stereophonic channels by means of the first pin and the transmission of the second channel by means of the second pin, or the transmission of the two stereophonic channels by means of only one of the pins. It can be arranged so as to be able to be converted into a connection plug for stereophonic headphones with a single pin.

The connection pins can be pins of the jack type, one of the pins having two coaxial conductors and the second having three coaxial conductors.

According to one embodiment, the connection plug can be arranged so as to be able to be cut so as to detach therefrom a part containing the pin having two coaxial conductors and to keep only the pin having three coaxial conductors and allowing the transmission of the two stereophonic channels.

It can have a frangible zone delimiting two parts, each of the parts including one of the pins.

According to another embodiment, the pin having two coaxial conductors is arranged so as to be able to be disconnected from the connection plug.

According to another embodiment, the connection plug comprises two distinct parts, each of the said parts supporting one of the said pins, the said parts having on the one hand members intended for their connection/disconnection and on the other hand means for their electrical connection.

The invention also concerns stereophonic headphones having a connection plug as defined above.

FIG. 1 is a schematic representation, partially in section, of an example of a connection plug according to the invention, FIG. 2 is an overall view of headphones provided with the connection plug of FIG. 1, FIG. 3 depicts the electrical connection diagram of the connection plug of FIGS. 1 and 2, FIGS. 4 and 5 are schematic representations of another embodiment of the connection plug according to the invention, and FIG. 6 is a cross-section along line A—A of the connection plug of FIG. 5.

The connection plug 1 depicted in FIGS. 1 and 2 has two connection pins 4 and 5, the whole being arranged so as to be able to be connected to a stereophonic socket on an aircraft seat.

The pin 4 is a pin of the well-known jack type having two coaxial conductors 42 and 44, the central conductor 42 being fixed to an external contact 41 and the external conductor 44 itself serving as an external contact, the two contacts 41 and 44 being separated by an insulant 43.

The second pin 5 is a pin of the traditional jack type with three coaxial conductors affording, by themselves alone, the transmission of the two stereo channels. To this end, it has a first central conductor 52 ending at an external contact 51, a second intermediate coaxial conductor 55 fixed to an external contact 54 and a third external coaxial conductor 57 itself serving as an external contact, the external contacts 51 and 54 being separated by an insulating element 53 and the contacts 54 and 57 being separated by an insulating element 56.

The two coaxial conductors 42 and 44 of the pin 4 are respectively connected electrically (by means of conducting wires 45, 46 or any other suitable means) to the intermediate coaxial conductor 55 and to the external coaxial conductor 57 of the pin 5, so that, when the two pins 4 and 5 of the connection plug are connected to the audio socket on an aircraft seat, the connection plug 1 functions in the traditional manner for listening with stereophonic headphones in an aircraft, that is to say one of the stereo channels is transmitted by the contact 41 on the pin 4, the second channel being transmitted by the contact 51 on the pin 5, the contact 44, connected to the contact 57, being connected to earth.

According to one embodiment, the outside diameter of the contact 54 is smaller than the outside diameter of the contact 57 and of the insulating elements 53 and 56, so as to make it possible to place a sheath around the contact 54, for example a heat-shrinking sheath, which makes it possible to prevent any risk of short-circuit during the use of the headphones in an aircraft, if by chance the contact spring on the female socket intended to receive the pin 5 is ill-suited. This sheath is of course arranged so as to be able to be removed before using the headphones in stereophonic listening mode with a single pin. The placement of a sheath around the contact 54 is only optional, since in the majority of cases, the reduction of the diameter of contact 54 is sufficient to avoid any risk of short-circuit.

When the connection plug 1 has been converted by removing the pin 4 or the part 3 including the pin 4, and where applicable after removal of the sheath covering the contact 54, the connection plug then functions as a traditional connection plug with a single stereophonic connection pin, the contacts 51 and 54 being intended to transmit the respective signals from each of the two stereophonic channels, the contact 57 being intended to be connected to earth.

The connection plug depicted in FIG. 1 is arranged so as to be able to be divided into two parts, the first part 2 including the pin 5 as well as the device for connection to the headphones and the electrical circuit connecting the pin 5 to the said device, whilst the second part 3 includes only the pin 4.

Thus, at the end of the flight, the passenger can divide the connection plug along the line 6 and remove the part 3. He then keeps the headphones provided only with the part 2 of the connection plug, which he can then use with any normal audio-visual equipment, whether it is a case of a Walkman, a Discman or a television.

The connection plug according to the present invention can be produced from any flexible or hard plastics material and have, according to circumstances, a frangible zone along the line 6, intended to be cut, for example by means of a pair of scissors, or broken.

According to an embodiment, the parts 2 and 3 of the connection plug, including respectively the pins 5 and 4, can be produced separately, each of the said parts having members for its connection with the other part, the electrical connection being able to be effected for example by means of a male plug mounted on the part 3 and intended for its connection to a female socket mounted on the part 2, or by any other suitable electrical connection means.

An example of such an embodiment where the two parts 2 and 3 of the connection plug are produced separately is represented in FIGS. 4 to 6. Said two parts 2 and 3 of the connection plug are connected by their corresponding end faces 70 and 71. As shown on FIGS. 5 and 6, the end face 70 of part 2 comprises a longitudinal projecting part 72 intended to cooperate with a longitudinal groove 73 provided in end face 71 of part 3. The projecting part 72 is of trapezoidal cross-section, with its small base close to the face 70, while groove 73 is of corresponding trapezoidal shape. Of course, said projecting part and groove can be replaced by any other suitable connection members, or by screwing or clipping means.

As shown in FIG. 5, part 3 of the connection plug can be disconnected of part 2 by a sliding up movement in the direction of the arrow 78. A reconnection of part 2 on part 3 can be obtained by an inverse movement. Part 2 is provided with an abutment means 79 acting as a stop for the sliding down movement of part 2. In this embodiment, conducting wires 45 and 46, connecting the two coaxial conductors 42 and 44 of pin 4 to the intermediate coaxial conductor 55 and to the external coaxial conductor 57 of pin 5 (see FIG. 1) are interrupted on each of the corresponding end faces 70 and 71 of parts 2 and 3. Each of the interrupted wires 45 and 46 is provided with electrical surface contacts 74, 75 and 74', 75' on the corresponding end faces 70 and 71 of parts 2 and 3, respectively on the front face 72' of the projecting part 72 of part 2 and on the bottom face 73' of the groove 73 of part 2. In order to obtain a good electrical connection between said surface contacts 74, 75 and 74, 75', said surface contacts are slightly bearing out on the corresponding end faces 72' and 73'. Of course, said surface contacts can be replaced by any other suitable electrical connection means.

As represented on FIGS. 4 and 5, the outside diameter of the contact 57 of pin 5 can be smaller than the outside diameter of the insulating elements 53 and 56, in order to prevent any risk of short-circuiting during the use of the headphones in an aircraft.

According to another embodiment of the connection plug, the pin 4 can be produced so as to be able to be disconnected from the connection plug, for example by screwing or clipping on.

As depicted in FIG. 2, the connection plug according to the invention is connected to earphones 20 and 21. Naturally, the connection plug according to the invention can be associated with any other type of stereophonic headphones which are currently found on the market, and likewise the connection plug can have any form different than that depicted in the figures.

What is claimed is:

1. A connection plug for stereophonic headphones for the transmission of two stereophonic channels, comprising first and second connection pins of the jack type having parallel, spaced-apart axes, wherein the first pin has two coaxial conductors and the second pin has three coaxial conductors, and wherein said connection plug is provided with electric connections permitting the transmission of only one of the two stereophonic channels by means of the first pin and the transmission of the two stereophonic channels by means of the second pin, said connecting plug comprising two distinct parts, each of said parts supporting one of said pins, said distinct parts having members intended for their connection/disconnection and means for their electrical connection.

2. A connection plug according to claim 1, wherein said members intended for the connection/disconnection of said two parts are provided on two corresponding end faces of said two parts, said end face of one of said two parts being provided with a projecting part arranged to cooperate with a groove in the end face of the other of said two parts.

3. A connection plug according to claim 2, wherein said projecting part and said groove are of corresponding trapezoidal shape.

4. A connecting plug according to claim 2, wherein said electrical connection means are surface contacts situated respectively on the front face of said projecting part and on the bottom face of said groove.

5. Stereophonic headphones comprising a connection plug according to claim 1.

6. Stereophonic headphones comprising a connection plug according to claim 2.

7. Stereophonic headphones comprising a connection plug according to claim 3.

8. Stereophonic headphones comprising a connection plug according to claim 4.

* * * * *